US009797206B2

(12) United States Patent
Elliott

(10) Patent No.: US 9,797,206 B2
(45) Date of Patent: Oct. 24, 2017

(54) STABILIZATION OF WELL LIFT FRAME

(71) Applicant: Stingray Offshore Solutions, LLC, Houston, TX (US)

(72) Inventor: Matthew S. Elliott, Houston, TX (US)

(73) Assignee: Stingray Offshore Solutions, LLC, Houston, TX (US)

( * ) Notice: Subject to any disclaimer, the term of this patent is extended or adjusted under 35 U.S.C. 154(b) by 301 days.

(21) Appl. No.: 14/535,082

(22) Filed: Nov. 6, 2014

(65) Prior Publication Data

US 2016/0130888 A1 May 12, 2016

(51) Int. Cl.
*E21B 19/06* (2006.01)

(52) U.S. Cl.
CPC ..... *E21B 19/06* (2013.01)

(58) Field of Classification Search
CPC ..... E21B 19/00; E21B 19/06; E21B 19/07; E21B 19/08
See application file for complete search history.

(56) References Cited

U.S. PATENT DOCUMENTS

| | | | | |
|---|---|---|---|---|
| 2,599,458 | A * | 6/1952 | Jones | E21B 43/12 137/112 |
| 3,695,363 | A * | 10/1972 | Kelly, Jr. | E21B 3/02 173/152 |
| 4,450,606 | A * | 5/1984 | Broussard | E21B 19/10 175/423 |
| 2006/0011351 | A1* | 1/2006 | Lambert | B66F 11/04 166/379 |
| 2011/0259576 | A1* | 10/2011 | Mulder | E21B 19/10 166/77.51 |
| 2012/0181084 | A1* | 7/2012 | Pilgrim | E21B 21/01 175/57 |

* cited by examiner

*Primary Examiner* — Giovanna C Wright
*Assistant Examiner* — Manuel C Portocarrero
(74) *Attorney, Agent, or Firm* — Haynes and Boone, LLP

(57) ABSTRACT

A well lift frame stabilizer, system, and method for stabilization thereof is disclosed. In an embodiment, the stabilizer includes one or more engagement mechanisms carried by one or more extension arms. The extension arms may be movable between a retracted position, in which the engagement mechanisms are not captured by a pair of vertical stabilization rails, and an extended position, in which the engagement mechanisms are vertically movably captured between the stabilization rails. A drive mechanism may be provided to move the extension arms and to sequentially operate the engagement mechanisms to first, engage side rollers, and then to subsequently engage front and back rollers against the rails.

21 Claims, 9 Drawing Sheets

STABILIZATION OF WELL LIFT FRAME

TECHNICAL FIELD

The present disclosure relates to well operations, and more specifically to a device and method for stabilizing a well lift frame.

BACKGROUND

Certain well operations, such as well intervention using coiled tubing injection, require a lift frame to position equipment above the wellhead and structurally support the equipment while well operations are being performed. The lift frame may be suspended from a derrick. A tubular string or other equipment may be hung from bail points, typically located at the bottom or near the lower end of the lift frame or through a vertical slot formed in the lift frame itself, typically in a lower section of the lift frame.

When well operations are performed offshore, the lift frame may include motion compensating systems to account for heave of the drilling platform or vessel. Because offshore platforms are also subject to wind, waves and currents, which may produce lateral offsets of the platform, one or more lift frame stabilizers may be used to ensure that the central axis of the lift frame is kept collinear with the platform well center during various operations.

A lift frame stabilizer may attach to attachment points on the lift frame and may be designed to roll up and down within a pair of vertical stabilization rails attached to the platform for stabilization purposes. Therefore, a lift frame stabilizer allows for heave compensation while simultaneously laterally stabilizing the lift frame for safe operation.

BRIEF DESCRIPTION OF THE DRAWINGS

Embodiments are described in detail hereinafter with reference to the accompanying figures, in which.

DETAILED DESCRIPTION

Figure 1:
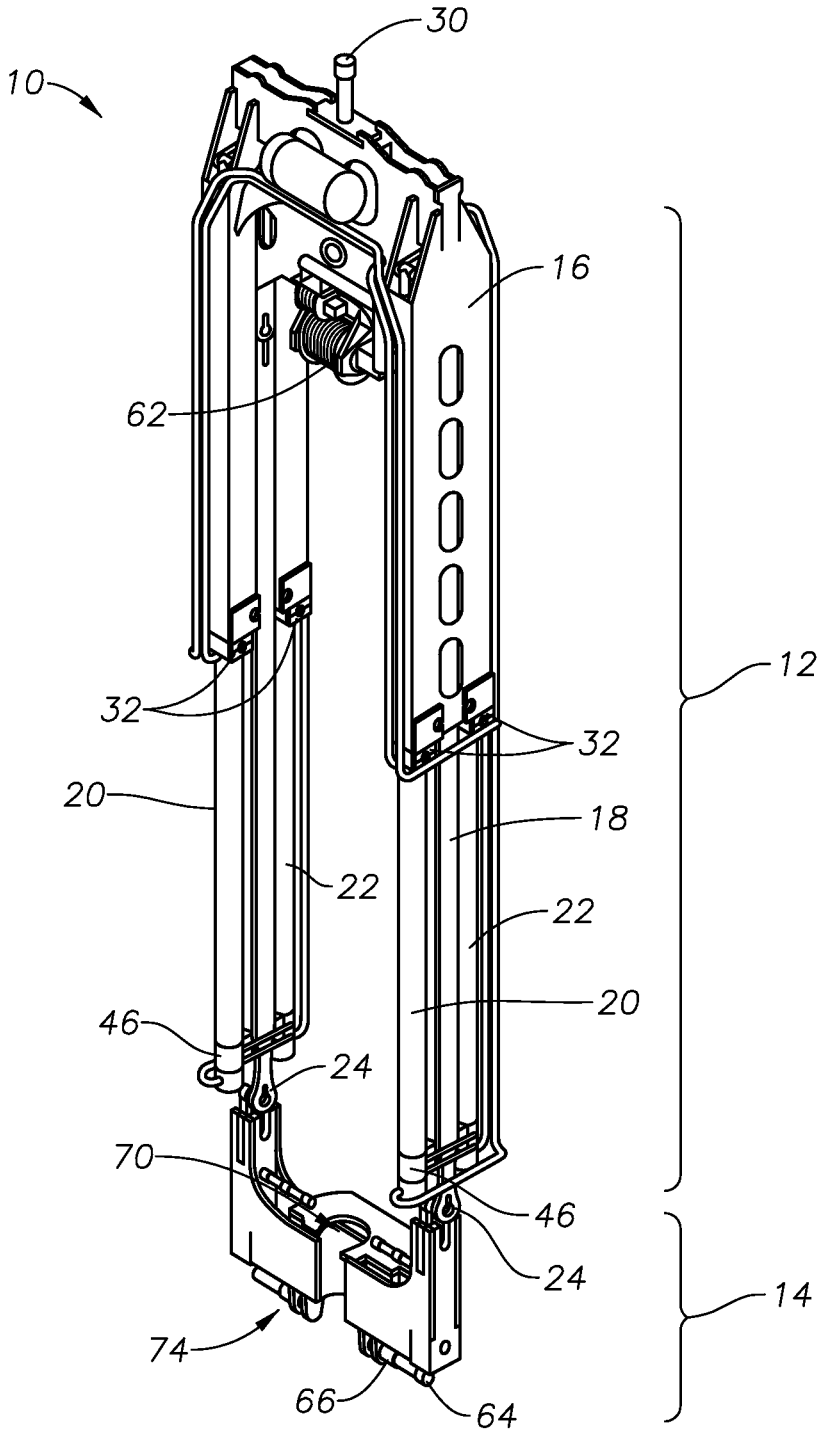
FIG. 1 is a perspective view of a well lift frame system according to an embodiment, showing an upper section for suspension by a derrick and a motion-compensated lower section for safely suspending a string or other equipment.

The present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," "front," "back," "left," "right," "top," "bottom," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. In addition, figures are not necessarily drawn to scale but are presented for ease of explanation.

Various items of equipment such as pipes, valves, pumps, fasteners, fittings, bearings, etc., may be omitted to simplify the description. However, routineers in the art will realize that such conventional equipment may be employed as appropriate.

Figure 2:
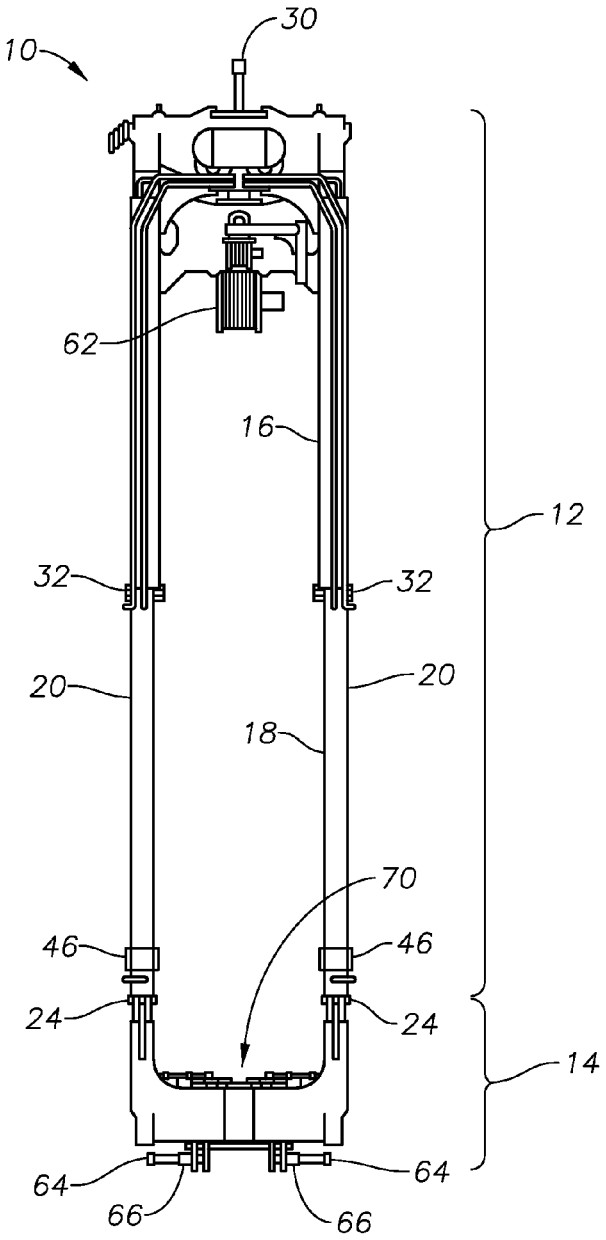
FIG. 2 is an elevation view of the front side of the lift frame of FIG. 1.
Figure 3:
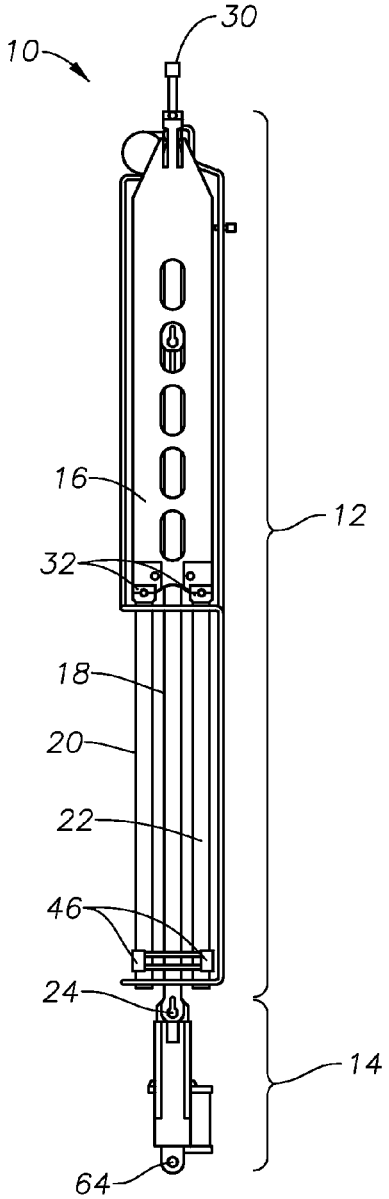
FIG. 3 is an elevation view of the left side of the lift frame of FIG. 1.

FIGS. 1-3 illustrate a motion-compensating well lift frame 10 according to an embodiment. Referring to FIGS. 1-3, lift frame 10 includes a frame 11, which may include upper section 12 and lower section 14. Upper section 12 may include outer frame 16 inner frame 18. Inner frame 18 may slide within outer frame 16 to provide vertical motion compensation, such as to account for heave in an offshore platform or vessel (not illustrated) on which lift frame 10 is carried. As illustrated, well lift frame 10 is in a retracted state.

Outer frame 16 may include a central lift attachment point 30, which may be directly connected to an elevator of a drilling derrick or other rig (not illustrated) to suspend lift frame 10. Lower section 14 may be unitary, or it may formed of two individual sub-sections that when connected to upper section 12 are held in position relative to one another. Upper section 12 and lower section 14 may be pinned together via pins 24 to allow for articulation or separation of the sections for either the addition of leg extensions (not illustrated) or to assist in the installation of lift frame 10 into the elevator. Additionally, anti-rotation pins (not illustrated) may be provided to selectively prevent the articulation about pins 24 of lower section 14 relative to upper section 12.

Both outer and inner frames 16, 18 may be substantially U-shaped, or more particularly, inverted U-shaped. Upper section 12 may also include two pairs of compensating cylinders 20 and 22. Compensating cylinders 20, 22 may be connected between outer and inner frames 16, 18 and may provide force and control necessary for motion compensation of device 10. Outer frame 16 may include fixed trunnions 32 and inner frame 18 may include cylinder guide brackets 46 for attachment of compensating cylinders 20, 22. As described in greater detail below, lift frame 10 may be arranged to carry strings and other equipment such as coiled tubing injector heads, blow-out preventer stacks, lubricators, and the like. Accordingly, to maintain such equipment at a fixed vertical position relative to the sea bed, compensating cylinders 20, 22 may be selectively activated.

When the sea surface rises, compensating cylinders 20, 22 may be retracted to maintain the vertical position of the well intervention device, and when the sea surface falls, cylinders 20, 22 are extended to maintain vertical position. Compensating cylinders 20, 22 may be hydraulic or pneumatic, for example.

Lower section 14 may be designed to support and carry strings or other equipment that extend to the sea bed. Lower section 14 may include structural attachment posts 64 where equipment may be carried via bails (not illustrated). Attachment posts 64 may be retractable into bushings 66 for facilitating installation of bails. Lift frame 10 may also include an overhead winch 62 to assist in positioning various equipment with respect to lower section 14. Winch 62 may be affixed to inner frame 18. Lift frame 10 may also include a vertical slot 70 having an opening in the side of lift frame 10, into which a tubular or other equipment (not illustrated) may be laterally positioned and carried by lift frame 10 in a manner similar to an elevator.

Although a particular motion-compensating lift frame 10 has been described hereinabove, other lift frame arrangements, both compensating and non-compensating, may also be used.

Figure 4:
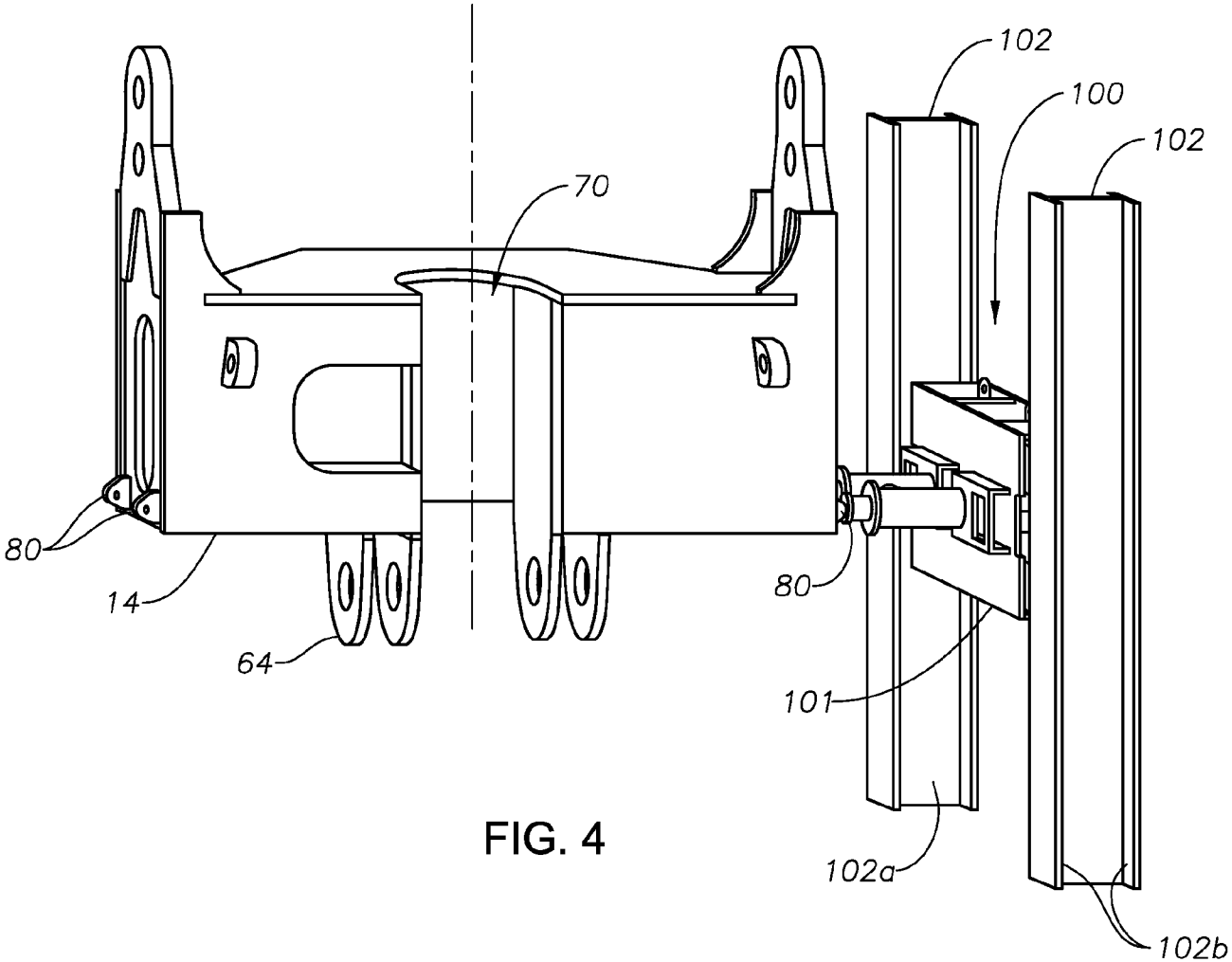
FIG. 4 is an enlarged perspective view of the lower section of the lift frame of FIG. 1 laterally stabilized by a lift frame stabilizer according to an embodiment, which is movably captured between a pair of vertical stabilization rails.

FIG. 4 is an enlarged perspective view of lower section 14 of lift frame 10 of FIG. 1 according to an embodiment. Lower section 14 may include pad eyes or other attachment points 80 for connection to one or more lift frame stabilizers 100. In FIG. 4, a single lift frame stabilizer 100, movably mounted between a single pair of vertical stabilization rails 102, is shown. However, in practice, a lift frame stabilizer and pair of vertical stabilization rails may be provided at each of opposing sides of lift frame 10 (FIG. 1). Lift frame stabilizer 100 may include a mount 104 dimensioned and arranged for removable connection to attachment points 80 of lift frame lower section 14.

In an embodiment, as shown in FIG. 4, vertical stabilization rails 102 may have I-beam profiles. However, channels, cylindrical rails, or other suitable structural members may also be used for forming vertical stabilization rails 102 as appropriate.

Figure 5:
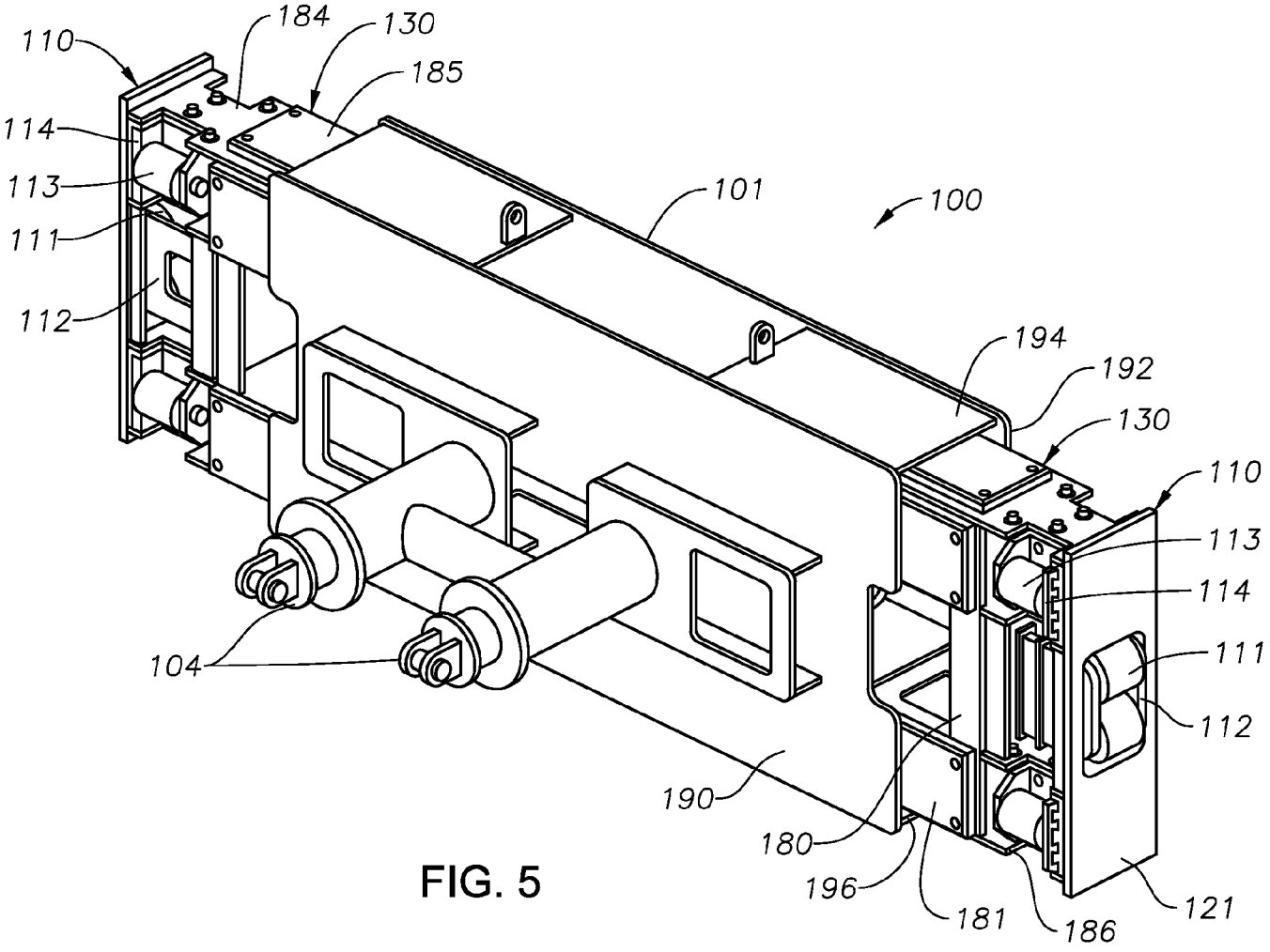
FIG. 5 is an enlarged perspective view of the front of the lift frame stabilizer of FIG. 4, showing a mount for connecting to the lower section of a lift frame and first and second extension arms carrying first and second engagement mechanisms according to an embodiment.
Figure 6:
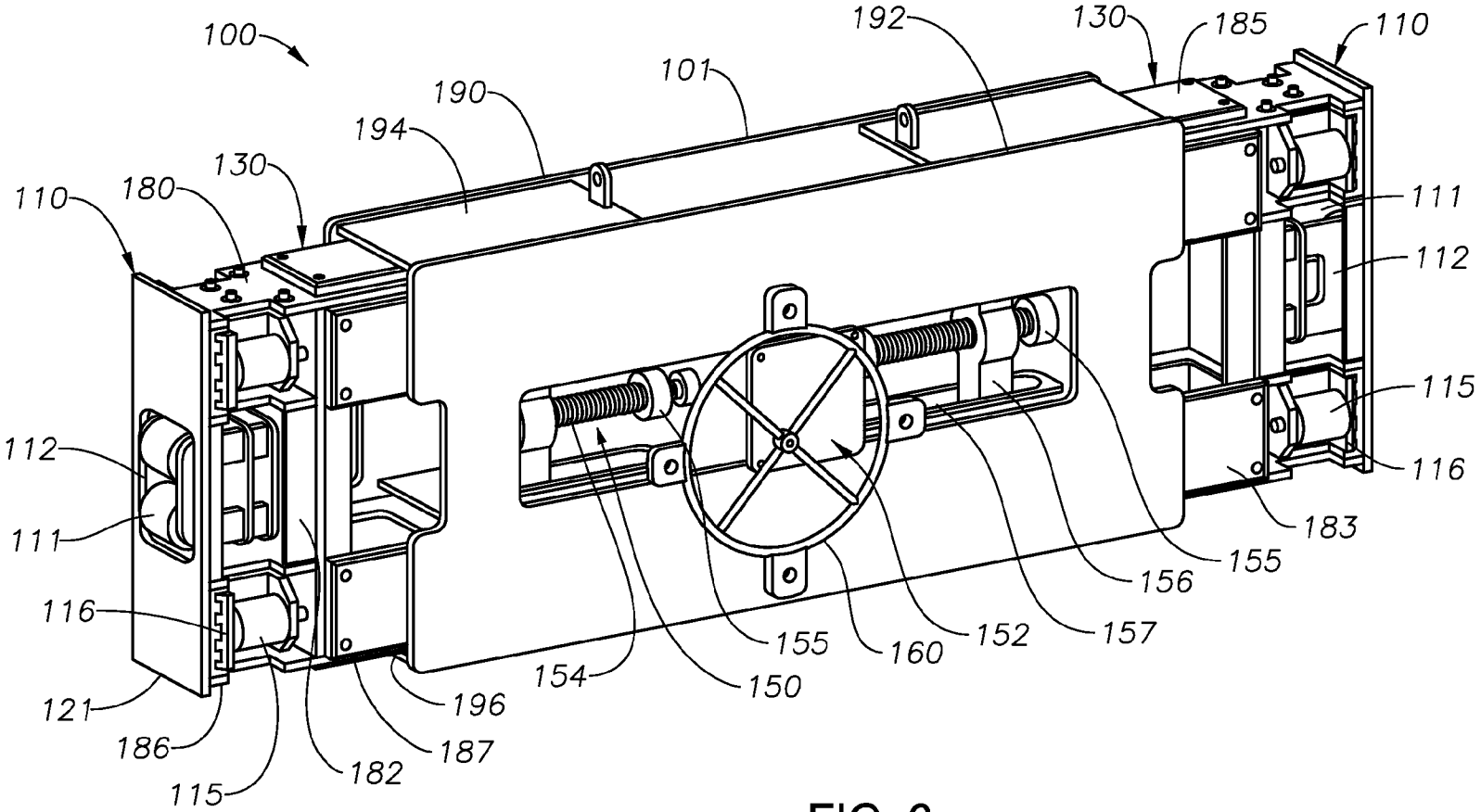
FIG. 6 is an enlarged perspective view of the front of the lift frame stabilizer of FIG. 5 showing portions of a drive mechanism according to an embodiment for moving the first and second extension arms between retracted and extended positions.

FIGS. 5 and 6 are enlarged perspective views of the front and back, respectively, of lift frame stabilizer 100 according to an embodiment. Referring to FIGS. 4-6, lift frame stabilizer 100 includes a stabilizer body 101. Stabilizer body 101 may include a front plate 190, a back plate 192, a top plate 194, and a bottom plate 196. Mount 104 may be provided on front plate 190 of stabilizer body 101 for removable connection to attachment points 80 of lift frame lower section 14.

Lift frame stabilizer 100 may include first and second engagement mechanisms 110 disposed on opposing sides, each of which may be arranged to be removably captured between a pair of vertically-oriented stabilization rails 102. Each engagement mechanism 110 may include at least one side roller 111 rotatively mounted within a side roller carrier assembly 112, which may be designed and arranged to engage and roll against a web 102*a* of stabilizer rail 102. Each engagement mechanism 110 may also include at least one front roller 113 and one back roller 115 rotatively mounted within front and back roller carrier assemblies 114, 116, respectively, which may be designed and arranged to engage and roll against the interior flanges 102*b* of stabilizer rail 102.

At least one of the first and second engagement mechanisms 110 may be carried by an extension arm 130. Extension arm 130 is connected to stabilizer body 101 so as to be movable with respect to stabilizer body 101 between a retracted position, in which first and second engagement mechanisms 110 are not captured by stabilization rails 102, and an extended position, in which first and second engagement mechanisms 110 are vertically movably captured between stabilization rails 102. Although only one extension arm 130 is needed for installing and removing lift frame stabilizer 100 from between stabilization rails 102, in the embodiments illustrated, first and second extension arms 130 are provided carrying first and second engagement mechanisms 110, respectively.

Figure 7:
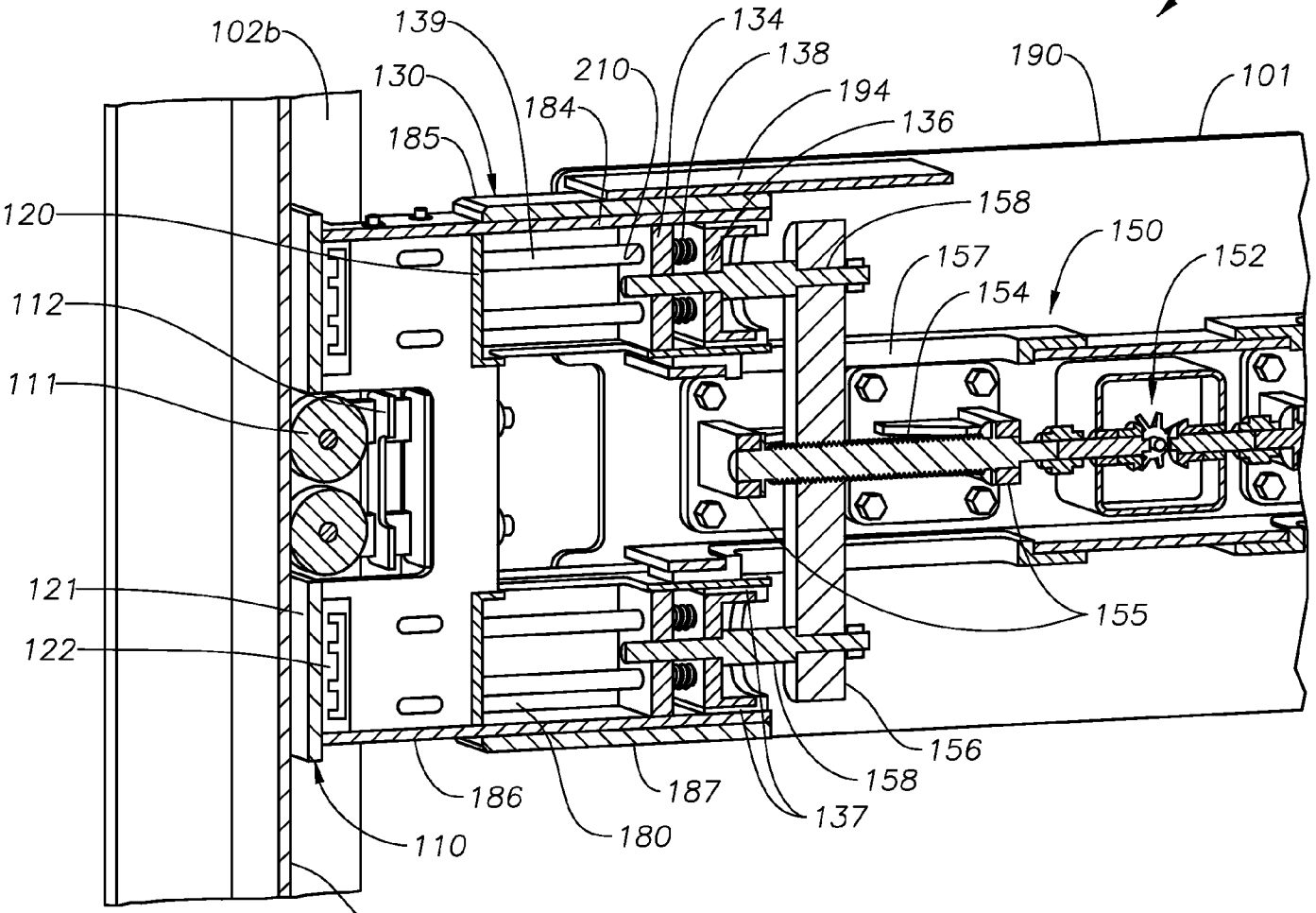
FIG. 7 is a vertical cross section of a portion of the lift frame stabilizer of FIG. 5 showing details of the drive mechanism and an extension arm.
Figure 8:
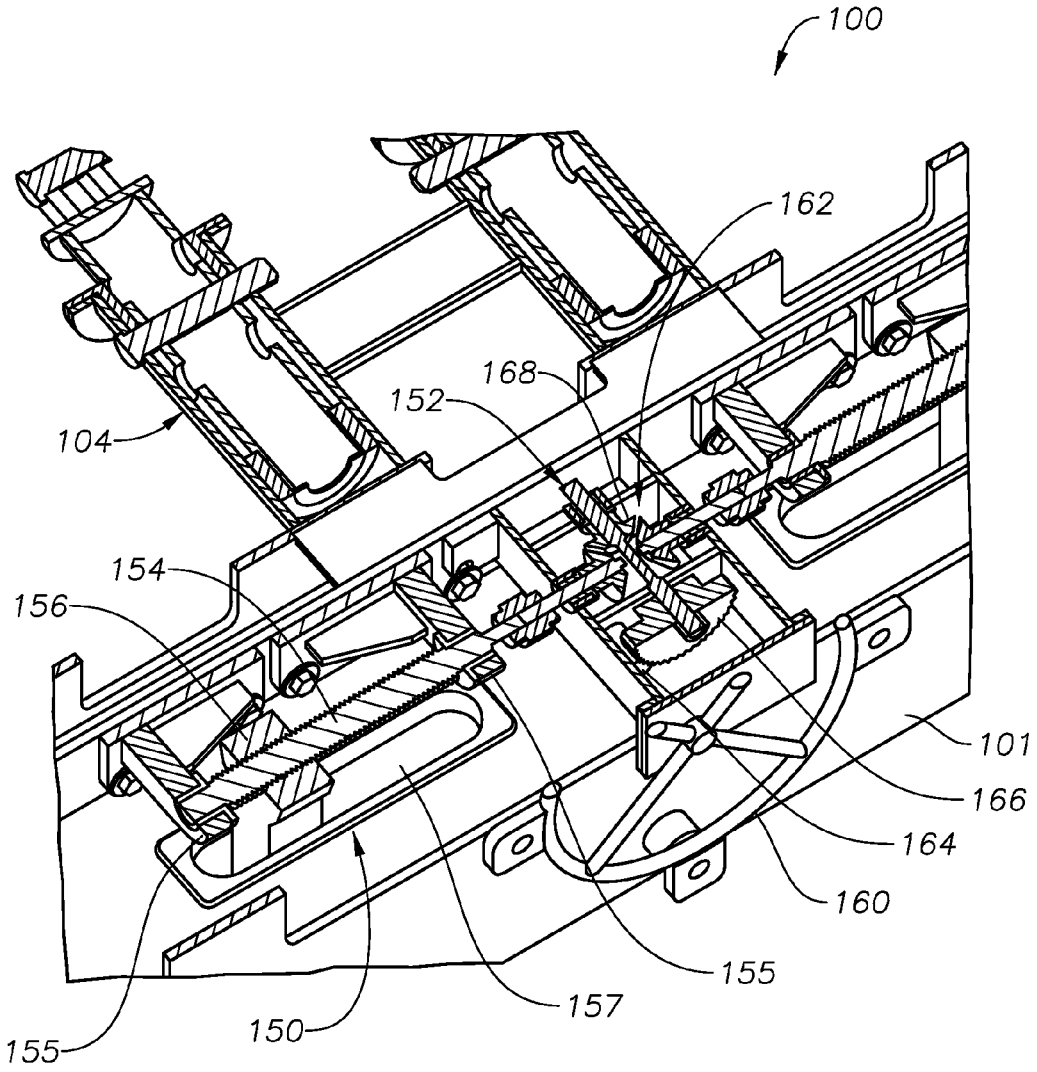
FIG. 8 is a horizontal cross section of a portion of the lift frame stabilizer of FIG. 6, showing details of the drive mechanism.

FIGS. 7 and 8 are vertical and horizontal cross sections, respectively, of a portion of lift frame stabilizer 100, according to an embodiment. Referring now to FIGS. 6-8, lift frame stabilizer 100 may include a drive mechanism 150 carried by stabilizer body 101. Drive mechanism 150 may be operable to move extension arm 130 between retracted and extended positions.

In an embodiment, drive mechanism may include an actuator 152 which may be operable to rotate a lead screw 154. Lead screw 154 may be rotatively supported within stabilizer body by pillow block bearings 155. Other suitable bearing arrangements may also be used as desired. A carriage 156 may be threadably engaged about lead screw 154 and prevented from rotating by being slideably captured within one or more slots 157. However, keys or other arrangements may be used to prevent rotation of carriage 156 as appropriate. Carriage 156 may be connected to extension arm 130, such as by a fastener 158. Thus, rotation of lead screw 154 may drive carriage 156, and in turn, extension arm 130.

In an embodiment, actuator 152 may include a prime mover 160 which may be operable to rotate lead screw 156 via a transmission 162. Transmission 162 may include a pinion 164 that may mesh with and drive a spur gear 166, which in turn may drive lead screw 156 via a bevel or miter gear set 168. Prime mover 160 may be a hand wheel, which may be manually rotated by an operator. Alternatively, prime mover 160 may be a hydraulic or electric motor (not illustrated) or the like.

Although a particular gear train is illustrated for transmission 162, any number of combinations of gear trains, including a worm drives, may be used as appropriate. Likewise, although a lead screw arrangement is illustrated for drive mechanism 150, other arrangements may also be employed. For example, a rack and pinion system, or a hydraulic cylinder (not illustrated) may be used to linearly move extension arm 130.

Figure 9:
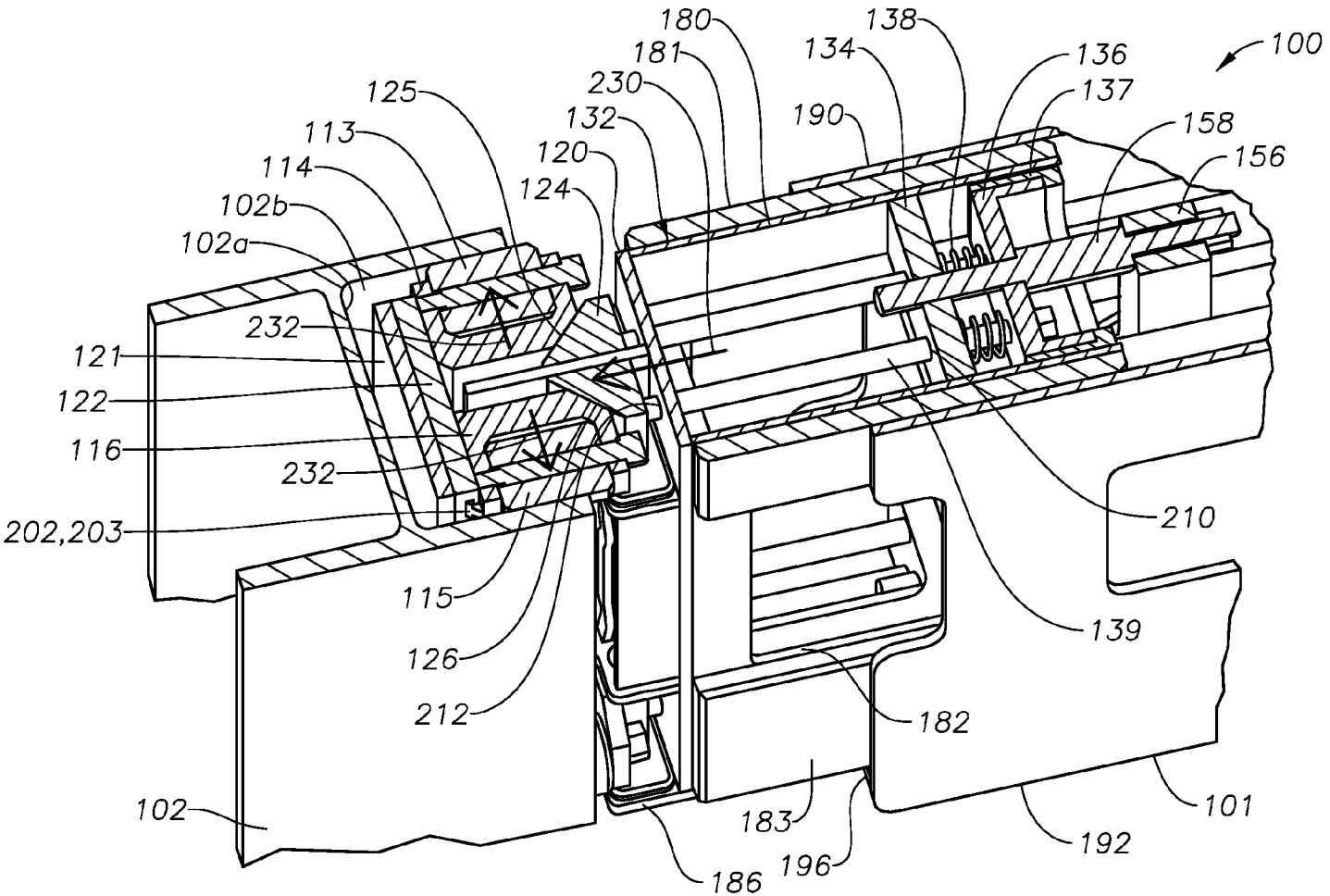
FIG. 9 is a horizontal cross section of a portion of the lift frame stabilizer of FIG. 6, showing details of an extension arm and an engagement mechanism.

FIG. 9 is a horizontal cross section of a portion of lift frame stabilizer 100 according to an embodiment. Referring to FIGS. 5-7 and 9, extension arm 130 may include a skeleton 132 formed of a front plate 180, a back plate 182, a top plate 184, and a bottom plate 186, to which front, back, top and bottom bearing pads 181, 183, 185, 187, respectively, may be mounted. Front, back, top and bottom bearing pads 181, 183, 185, 187 may slide against and be guided by the interior surfaces of front plate 190, back plate 192, top plate 194, and bottom plate 196, respectively, of stabilizer body 101, thereby allowing extension arm 130 to slide within stabilizer body 101.

A push block 134 may be rigidly connected to skeleton 132 of extension arm 130. Proximal to push block 134, a slide 136 with bearing pads 137 may be disposed to slide along the interior surfaces of front and back plates 180, 182 of skeleton 132. Slide 136 may be operatively connected to drive mechanism 150. For instance, in the embodiment illustrated, slide 136 is rigidly connected to carrier 156. A spring 138 may be disposed between push block 134 and slide 136. Thus, when drive mechanism 150 is actuated to move extension arm 130 from the retracted to the extended position, slide 136 is moved outwardly, which in turn applies an outward compressive force on push block 134 via spring 138, thereby urging extension arm 130 outwardly. Slide 136 may also be directly connected to engagement mechanism 110 with a push rod 139 for automatically engaging front and back rollers 113, 115 against interior flange 102*b* after side roller 111 has engaged web 102*a* of vertical stabilizer rail 102, as described in greater detail hereinafter.

Figure 10:
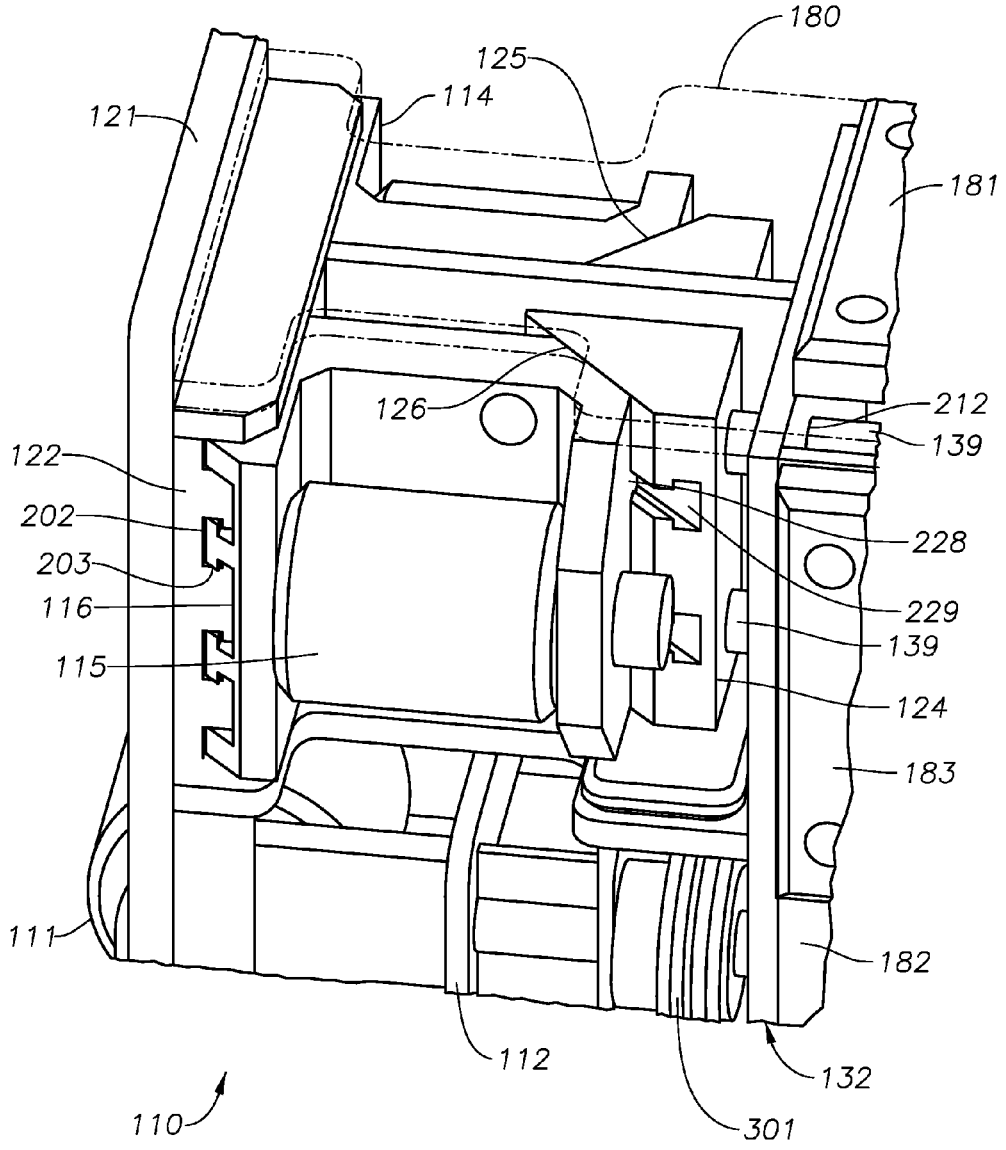
FIG. 10 is an enlarged perspective view of a portion of an engagement mechanism of the lift frame stabilizer of FIG. 9.

FIG. 10 is an enlarged perspective view of a portion of engagement mechanism 110 of lift frame stabilizer 100 according to an embodiment. Referring to FIGS. 7, 9 and 10, engagement mechanism 110 may include a base 120, which may be rigidly mounted to skeleton 132 of extension arm 130. Side roller carrier assembly 112, which may rotatively carry side roller 111, may be mounted to base 120. Such a mounting may include a stiff resilient member 301.

Side roller carrier assembly 112 may also carry an end plate 121, which may in turn carry a table 122. Table 122 may be arranged to carry front and back roller carrier assemblies 114, 116 in a manner that allows the carrier assemblies to slide forward and backward, respectively. In the embodiment illustrated, table 122 includes a T-slot 202, and front and back roller carrier assemblies 114, 116 are formed with a complementary T-head or T-rail 203. However, this arrangement may be reversed, with slots formed in the carrier assemblies 114, 116 and a rail formed on table 122. Moreover, profiles other than a "T" profile may be used as appropriate.

In an embodiment, a medial end of push rod 139 may be connected to slide 136. Push rod 139 may freely pass through a first aperture 210 formed through push block 134 and through a second aperture 212 formed through base 120. The distal end of push rod 139 may be connected to a wedge assembly 124. Thus, as slide 136 is moved by drive mechanism 150, wedge assembly 124 is likewise moved.

Wedge assembly may have forward- and rearward-facing beveled driving surfaces 125, 126, respectively, which may be formed at acute angles with respect to a planar surface defined by base 120. Front and back roller carrier assemblies 114, 116 may each be generally "C"-shaped with a medial corner being beveled. Forward- and rearward-facing beveled driving surfaces 125, 126 may slidingly engage and capture beveled driven surfaces of front and back roller carrier assemblies 114, 116, respectively. Specifically, a rearward-facing beveled driven surface formed on front roller carrier assembly 114 may be slidingly captured at forward-facing beveled driving surface 125 of wedge assembly 124, and a forward-facing beveled driven surface formed on rear roller carrier assembly 116 may be slidingly captured at rearward-facing driving surface 126 of wedge assembly 124. The angles of forward- and rearward-facing beveled driving surfaces 125, 126 and the beveled surfaces of front and back roller carriers 114, 116 may be selected so that front and back rollers 113, 115 perpendicularly engage inner flange surfaces 102*b* of vertical stabilizer rail 102.

In the embodiment illustrated, beveled driving surfaces 125, 126 of wedge assembly 124 include a T-slots 228, and the beveled driven surfaces of front and back roller carrier assemblies 114, 116 are formed with complementary T-heads or T-rails 229. However, this arrangement may be reversed, with slots formed in the carrier assemblies 114, 116 and rails formed on wedge assembly 124. Moreover, profiles other than a "T" profile may be used as appropriate.

In operation, as drive mechanism 150 moves extension arm 130 from the retracted to the extended position, initially slide 136 may simultaneously move skeleton 132 and base 120, via push block 134 and spring 138, and wedge assembly 124, via push rod 139. This motion is indicated by arrow 230. Once side roller 111 contacts web 102*a* of stabilizer rail 102, further outward motion of extension arm 130, and hence front and side roller carrier assemblies 114, 116, must necessarily cease. Drive mechanism 150 may, however, continue to move slide 136, push rod 139 and wedge assembly 124 outwardly, while compressing spring 138. As the distance between wedge assembly 124 and table 122 is lessened, forward- and rearward-facing beveled driving surfaces 125, 126 of wedge assembly 124 act upon the beveled driven surfaces to force front and back roller carrier assemblies 114, 116 against the inner flange surfaces 102*b* of stabilization rails 102. This motion is indicated by arrows 232. When stabilizer 100 is to be disengaged from rails 102, drive mechanism 150 may simply be operated in reverse.

As described and illustrated herein, lift frame stabilizer 100 may allow for quick and easy installation of the stabilizer in between stabilization rails 102. Stabilizer 100 may be adapted for any application requiring a structure to be mounted between two rails while maintaining an ability to roll or slide along the length of the rails.

In summary, lift frame stabilizer, a stabilized well lift frame system, and a method for stabilizing a well lift frame have been described. Embodiments of the lift frame stabilizer may have: A stabilizer body defining a front, a back, and first and second opposing sides; a mount connected to the front of the stabilizer body and arranged for connection to an offshore lift frame; a first extension arm connected to the first side of the stabilizer body and movable with respect to the stabilizer body between a retracted position and an extended position; a first engagement mechanism carried at a distal end of the first extension arm and arranged for coupling to a vertically-oriented first rail so as to be vertically movable with respect to the first rail; a second engagement mechanism coupled to the second side of the stabilizer body and arranged for coupling to a vertically-oriented second rail so as to be movable with respect to the second rail; and a drive mechanism carried by the stabilizer body and arranged to move the extension arm between the retracted position, in which the first and second engagement mechanisms are not captured by the first and second rails, and the extended position, in which the first and second engagement mechanisms are vertically movably captured between the first and second rails. Embodiments of the lift frame stabilizer may have: A lift frame arranged for suspension from a derrick on an offshore platform or vessel and for carrying well equipment; vertically-oriented first and second stabilization rails mounted to the offshore platform or vessel in proximity to the lift frame; and a stabilizer disposed between the first and second rails and coupled to the lift frame, the stabilizer including a first extension arm movable with respect to the first rail between a retracted position and an extended position, a first engagement mechanism carried at a distal end of the first extension arm and removably coupled to the first rail so as to be vertically movable with respect to the first rail, a second engagement mechanism removably coupled to the second rail so as to be movable with respect to the second rail, and a drive mechanism arranged to move the extension arm between the retracted position, in which the first and second engagement mechanisms are not captured by the first and second rails, and the extended position, in which the first and second engagement mechanisms are vertically movably captured between the first and second rails. Embodiments of the method for stabilizing a well lift frame may generally include: Coupling a stabilizer to the lift frame; positioning the stabilizer between vertically-oriented first and second stabilization rails; and actuating a drive mechanism to move a first extension arm of the stabilizer from a retracted position, in which the stabilizer is not captured by the first and second rails, and an extended position, in which the stabilizer is movably captured between the first and second rails.

Any of the foregoing embodiments may include any one of the following elements or characteristics, alone or in combination with each other: A second extension arm connected to the second side of the stabilizer and movable between a retracted position and an extended position, the second engagement mechanism carried at a distal end of the second extension arm, the drive mechanism arranged to move the second extension arm between the retracted and extended positions; the drive mechanism is arranged to simultaneously move both the first and second extension arms between the respective retracted and extended positions; an actuator; a lead screw rotatable by the actuator; a carriage drivable by the lead screw, the carriage being coupled to the first extension arm for positioning thereof; a side roller rotatively mounted to a side roller carrier assembly; a front roller rotatively mounted to a front roller carrier assembly; a back roller rotatively mounted to a back roller carrier assembly; a base plate defining a planar surface, the side roller carrier assembly mounted to the base plate; a wedge assembly coupled to the base plate so as to be movable in a perpendicular direction with respect to the planar surface, the wedge assembly having forward- and rearward-facing beveled driving surfaces with respect to the planar surface; a rearward-facing beveled driven surface formed on the front roller carrier assembly slidingly captured at the forward-facing beveled driving surface of the wedge assembly; a forward-facing beveled driven surface formed on the rear roller carrier assembly slidingly captured at the rearward-facing driving beveled surface of the wedge assembly; a table, the front and rear roller carrier assemblies slideably captured by the table; the forward- and rearward-facing beveled driving surfaces of the wedge assembly and the table each have a T-slot formed therein for slideably capturing the front and rear roller carrier assemblies; a guide slidingly coupled to the stabilizer body; a rod connected between the drive mechanism and the wedge assembly; and a spring coupled between the drive mechanism and the base plate; actuating the drive mechanism to move a second extension arm; simultaneously moving both the first and second extension arms by the drive mechanism; moving by the drive mechanism a side roller into engagement with the first rail; and then moving by the drive mechanism a front roller and a back roller into engagement with the first rail.

The Abstract of the disclosure is solely for providing a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A lift frame stabilizer comprising:

a stabilizer body defining a front, a back, a top, a bottom, and first and second opposing sides;

a mount connected to the front of said stabilizer body and arranged for connection to an offshore lift frame;

a first extension arm connected to said first side of said stabilizer body and movable with respect to said stabilizer body between a retracted position and an extended position;

a first engagement mechanism carried at a distal end of said first extension arm and arranged for coupling to a vertically-oriented first rail so as to be vertically movable with respect to said first rail;

a second engagement mechanism coupled to said second side of said stabilizer body and arranged for coupling to a vertically-oriented second rail so as to be movable with respect to said second rail; and a drive mechanism carried by said stabilizer body and arranged to move said extension arm between said retracted position, in which said first and second engagement mechanisms are not captured by said first and second rails, and said extended position, in which said first and second engagement mechanisms are vertically movably captured between said first and second rails.

2. The lift frame stabilizer of claim 1 further comprising:

a second extension arm connected to said second side of said stabilizer body and movable between a retracted position and an extended position, said second engagement mechanism carried at a distal end of said second extension arm, said drive mechanism arranged to move said second extension arm between said retracted and extended positions.

3. The lift frame stabilizer of claim 2 wherein:

said drive mechanism is arranged to simultaneously move both said first and second extension arms between said respective retracted and extended positions.

4. The lift frame stabilizer of claim 3 wherein said drive mechanism comprises:

an actuator;

a lead screw rotatable by said actuator; and a carriage drivable by said lead screw, said carriage being coupled to said first extension arm for positioning thereof.

5. The lift frame stabilizer of claim 1 wherein said first engagement mechanism comprises:

a side roller rotatively mounted to a side roller carrier assembly;

a front roller rotatively mounted to a front roller carrier assembly; and a back roller rotatively mounted to a back roller carrier assembly.

6. The lift frame stabilizer of claim 5 wherein said first engagement mechanism further comprises:

a base plate defining a planar surface, said side roller carrier assembly mounted to said base plate;

a wedge assembly coupled to said base plate so as to be movable in a perpendicular direction with respect to said planar surface, said wedge assembly having forward- and rearward-facing beveled driving surfaces with respect to said planar surface;

a rearward-facing beveled driven surface formed on said front roller carrier assembly slidingly captured at said forward-facing beveled driving surface of said wedge assembly; and a forward-facing beveled driven surface formed on said rear roller carrier assembly slidingly captured at said rearward-facing driving beveled surface of said wedge assembly.

7. The lift frame stabilizer of claim 6 wherein said first engagement mechanism further comprises:

a table, said front and rear roller carrier assemblies slideably captured by said table.

8. The lift frame stabilizer of claim 7 wherein:

said forward- and rearward-facing beveled driving surfaces of said wedge assembly and said table each have a T-slot formed therein for slideably capturing said front and rear roller carrier assemblies.

9. The lift frame stabilizer of claim 6 wherein said first extension arm comprises:

a guide slidingly coupled to said stabilizer body;

a rod connected between said drive mechanism and said wedge assembly; and a spring coupled between said drive mechanism and said base plate.

10. A stabilized well lift frame system comprising:

a lift frame arranged for suspension from a derrick on an offshore platform or vessel and for carrying well equipment;

vertically-oriented first and second stabilization rails mounted to said offshore platform or vessel in proximity to said lift frame; and a stabilizer disposed between said first and second rails and coupled to said lift frame, said stabilizer including:

a first extension arm movable with respect to said first rail between a retracted position and an extended position;

a second extension arm movable with respect to said second rail between a retracted position and an extended position;

a first engagement mechanism carried at a distal end of said first extension arm and removably coupled to said first rail so as to be vertically movable with respect to said first rail;

a second engagement mechanism carried at a distal end of said second extension arm and removably coupled to said second rail so as to be movable with respect to said second rail; and a drive mechanism arranged to move said first and second extension arms between said retracted position, in which said first and second engagement mechanisms are not captured by said first and second rails, and said extended position, in which said first and second engagement mechanisms are vertically movably captured between said first and second rails.

11. The lift frame system of claim 10 wherein:

said drive mechanism is arranged to simultaneously move both said first and second extension arms between said respective retracted and extended positions.

12. The lift frame system of claim 11 wherein said drive mechanism comprises:

an actuator;

a lead screw rotatable by said actuator; and a carriage drivable by said lead screw, said carriage being coupled to said first extension arm for positioning thereof.

13. The lift frame system of claim 10 wherein said first engagement mechanism comprises:

a side roller rotatively mounted to a side roller carrier assembly;

a front roller rotatively mounted to a front roller carrier assembly; and a back roller rotatively mounted to a back roller carrier assembly.

14. The lift frame system of claim 13 wherein said first engagement mechanism further comprises:

a base plate defining a planar surface, said side roller carrier assembly mounted to said base plate;

a wedge assembly coupled to said base plate so as to be movable in a perpendicular direction with respect to said planar surface, said wedge assembly having forward- and rearward-facing beveled driving surfaces with respect to said planar surface;

a rearward-facing beveled driven surface formed on said front roller carrier assembly slidingly captured at said forward-facing beveled driving surface of said wedge assembly; and a forward-facing beveled driven surface formed on said rear roller carrier assembly slidingly captured at said rearward-facing driving beveled surface of said wedge assembly.

15. The lift frame system of claim 14 wherein said first engagement mechanism further comprises:

a table, said front and rear roller carrier assemblies slideably captured by said table.

16. The lift frame system of claim 15 wherein:

said forward- and rearward-facing beveled driving surfaces of said wedge assembly and said table each have a T-slot formed therein for slideably capturing said front and rear roller carrier assemblies.

17. The lift frame system of claim 14 wherein said first extension arm comprises:

a rod connected between said drive mechanism and said wedge assembly; and a spring coupled between said drive mechanism and said base plate.

18. A method for stabilizing a well lift frame comprising the steps of:

coupling a stabilizer to said lift frame;

positioning said stabilizer between vertically-oriented first and second stabilization rails such that a first engagement mechanism is removably coupled to said first rail and a second engagement mechanism is removably coupled to said second rail; and actuating a drive mechanism to move a first extension arm of said stabilizer from a retracted position, in which said first and second engagement mechanisms are not captured by said first and second rails, and an extended position, in which said first and second engagement mechanisms are movably captured between said first and second rails.

19. The method of claim 18 further comprising the step of:

actuating said drive mechanism to move a second extension arm.

20. The method of claim 19 further comprising the step of:

simultaneously moving both said first and second extension arms by said drive mechanism.

21. The method of claim 18 further comprising the step of:

moving by said drive mechanism a side roller into engagement with said first rail; and then moving by said drive mechanism a front roller and a back roller into engagement with said first rail.

* * * * *